US006474952B1

(12) United States Patent
Fisher et al.

(10) Patent No.: US 6,474,952 B1
(45) Date of Patent: Nov. 5, 2002

(54) SUMP PUMP MOTOR SWITCH ASSEMBLY

(75) Inventors: L. Edwin Fisher, Fort Wayne, IN (US); Marc D. Pape, Fort Wayne, IN (US); Mark A. Reiter, Fort Wayne, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/428,630

(22) Filed: Oct. 27, 1999

Related U.S. Application Data

(60) Provisional application No. 60/141,669, filed on Jun. 30, 1999.

(51) Int. Cl.[7] ..... F04B 49/04; F04B 35/04

(52) U.S. Cl. ..... 417/40; 417/423.3; 200/84 R

(58) Field of Search ..... 417/40, 367, 423.3, 417/211.5; 318/473; 200/80 R, 84 R

(56) References Cited

U.S. PATENT DOCUMENTS

| | | | | | |
|---|---|---|---|---|---|
| 3,992,130 | A | | 11/1976 | Childress | |
| 4,001,533 | A | | 1/1977 | Conery et al. | |
| 4,196,325 | A | | 4/1980 | Povilaitis | |
| 4,626,755 | A | * | 12/1986 | Butcher et al. | 318/473 |
| 4,632,643 | A | * | 12/1986 | Nielsen | 417/367 |
| 4,894,496 | A | * | 1/1990 | Palumbo | 200/80 R |
| 4,916,274 | A | | 4/1990 | Hawley et al. | |
| 5,076,762 | A | * | 12/1991 | Lykes et al. | 417/40 |
| 5,562,423 | A | * | 10/1996 | Orth et al. | 417/40 |
| 5,613,835 | A | * | 3/1997 | Tyner | 417/182.5 |

* cited by examiner

*Primary Examiner*—Charles G. Freay
(74) *Attorney, Agent, or Firm*—Karl A. Vick, Esq.; Armstrong Teasdale LLP

(57) ABSTRACT

A sump pump motor switch assembly for a sump pump including a motor casing and an end shield, includes a switch assembly and a housing mounted to the end shield. A cam actuator is connected to the housing and a sump pump actuation switch is mounted with the cam actuator. A motor actuation switch is also mounted with the cam actuator body. The sump actuation switch and the motor actuation switch are snap action switches that are simultaneously actuated by the cam actuator. The switch assembly includes a snap fitting assembly configured to fit into a receiving retainer within the motor casing.

29 Claims, 4 Drawing Sheets

SUMP PUMP MOTOR SWITCH ASSEMBLY

CROSS REFERENCE TO RELATED APPLICATION

This application claims the benefit of U.S. Provisional Application No. 60/141,669, filed Jun. 30, 1999.

BACKGROUND OF THE INVENTION

This invention relates generally to sump pumps and, more particularly, to sump pump motor switches.

There are many different types of sump pump motor switches for use with a sump pump assembly for controlling a water level in a sump. Sump pump assemblies typically include a sump pump motor assembly and a sump pump assembly. Sump pump motor assemblies typically include a housing, a stator and a rotor assembly. The housing includes a shell and two end shields and encases at least a portion of the rotor assembly. The rotor assembly includes a rotor core and a rotor shaft coupled to a pump shaft.

Typically, sump pump motor assemblies also include a motor start switch and a sump pump actuator switch for controlling pump energization. The motor start switch energizes the pump when a drainage level in a sump reaches a predetermined level. The sump pump actuator switch de-energizes the pump when the drainage level in the sump is reduced below a predetermined depth. As such, separate switch assemblies are utilized which increase the cost of manufacturing and increase the required assembly times.

Accordingly, it would be desirable to provide a more cost-effective and efficient sump pump motor assembly. In addition, it would be desirable to provide a sump pump motor circuit that is reliable, simple to assemble, and also cost-effective.

BRIEF SUMMARY OF THE INVENTION

In an exemplary embodiment of the invention, a sump pump motor switch that is easy to assemble reliably controls the energization of a sump pump assembly.

The sump pump motor assembly includes a single switch assembly that combines the motor actuation switch and the pump actuation switch. The motor actuation switch and the pump actuation switch are snap action switches that are simultaneously actuated by a cam actuator. The cam actuator includes positioning stops which permit the switch assembly to be rapidly actuated and de-actuated. As a result, a separate motor actuation switch assembly including its associated mounting hardware and wiring is eliminated from the sump pump motor assembly.

Additionally, the switch assembly includes a snap fitting assembly which permits the switch assembly to be quickly and easily fitted to the sump pump motor assembly. Additionally, the sump pump motor assembly includes interior cavities to receive bearings in a proper position to contact a rotor shaft. As a result the sump pump assembly is not only simplified, but is more cost-effective than known pumps.

DETAILED DESCRIPTION OF THE INVENTION

Figure 1:
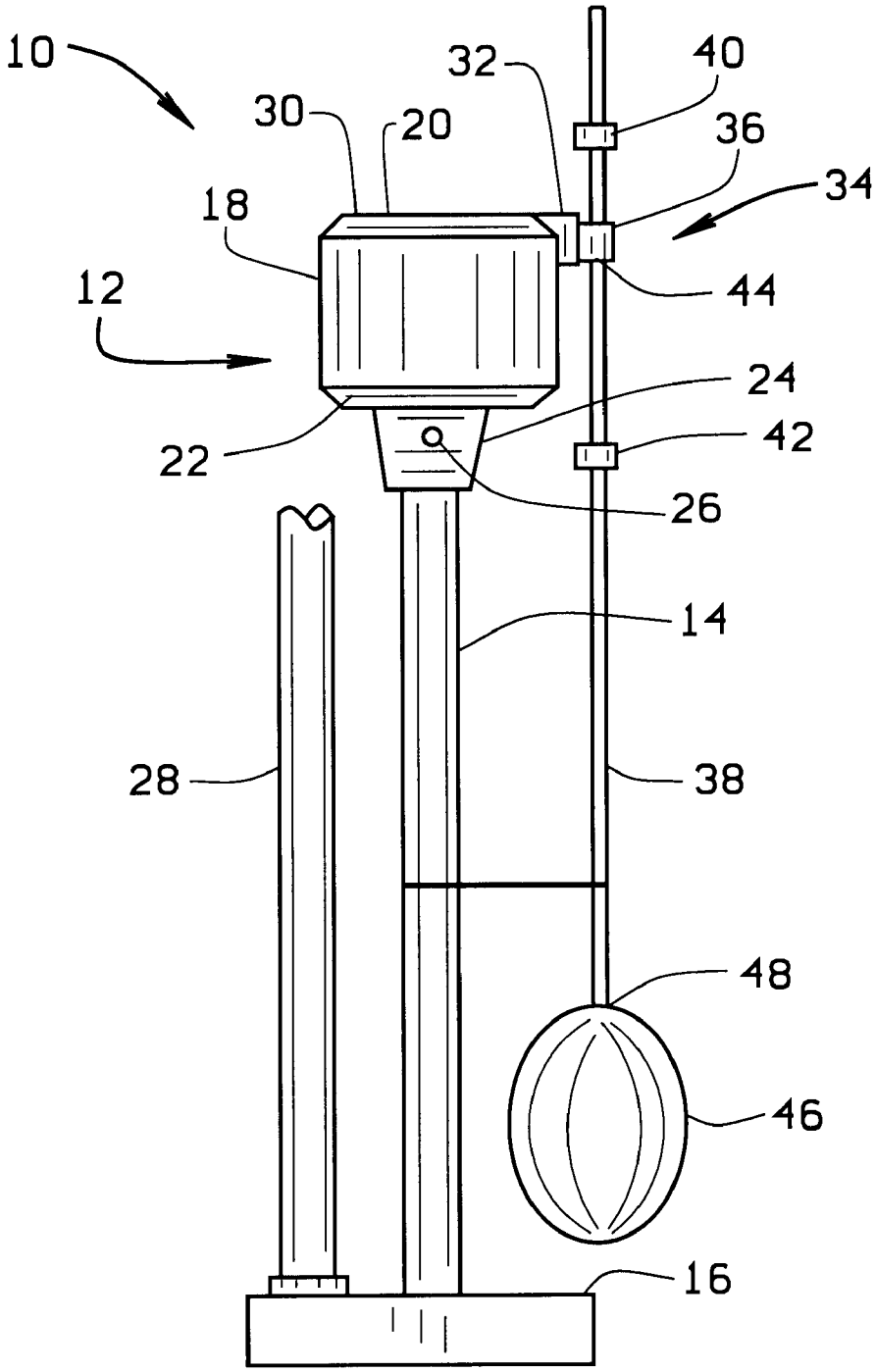
FIG. 1 is a side view of a sump pump assembly.

FIG. 1 is a side view of a sump pump assembly 10 including a sump pump motor assembly 12 supported by a support column 14. Support column 14 houses a rotatable shaft (not shown) driven by motor assembly 12 and coupled to a sump pump impeller (not shown) located in a sump pump base 16. Motor assembly 12 includes a motor casing 18 including a first end shield 20 and a second end shield 22. First end shield 20 and second end shield 22 are mounted to motor casing 18 and are fabricated from low cost stamped steel. Support column 14 is connected to a mounting hub 24 and base 16. Mounting hub 24 is positioned adjacent an opening (not shown) in second end shield 22. A discharge pipe 28 is connected to sump pump base 16 for removing drainage (not shown) from a sump (not shown).

First end shield 2Q includes an outer surface 30 upon which a sump pump float switch housing 32 is attached. A switch assembly (not shown in FIG. 1) is positioned within switch housing 32 and is electrically connected to motor 12. A cam actuator assembly 34 is connected to switch housing 32 and includes a cam body 36 and a float rod 38. Float rod 38 has a first cam position stop 40 and a second cam position stop 42. Float rod 38 extends through an opening 44 in cam body 36 and includes a float 46 attached to a first end 48. Opening 44 is sized so that float rod 38 easily slides therethrough as the amount of drainage in the sump changes. Opening 44 is also sized so that first cam position stop 40 and second cam position stop 42 can not slide through and instead contact cam body 36.

Sump pump assembly 10 is normally located within a sump wherein a drainage level is to be controlled and prevented from exceeding a certain level. Sump pump assembly 10 is positioned so that, as a level of the drainage rises, float 46 connected to float rod 38 will move upwardly. As the drainage level continues to rise, upward movement of float rod 38 will cause second cam position stop 42 to contact cam body 36 and actuate the switch assembly which energizes motor 12. As the drainage level recedes below a selected level, float 46 will move downwardly until first cam position stop 40 contacts cam body 36, at which time the switch assembly is de-actuated and motor 12 is de-energized.

Figure 2:
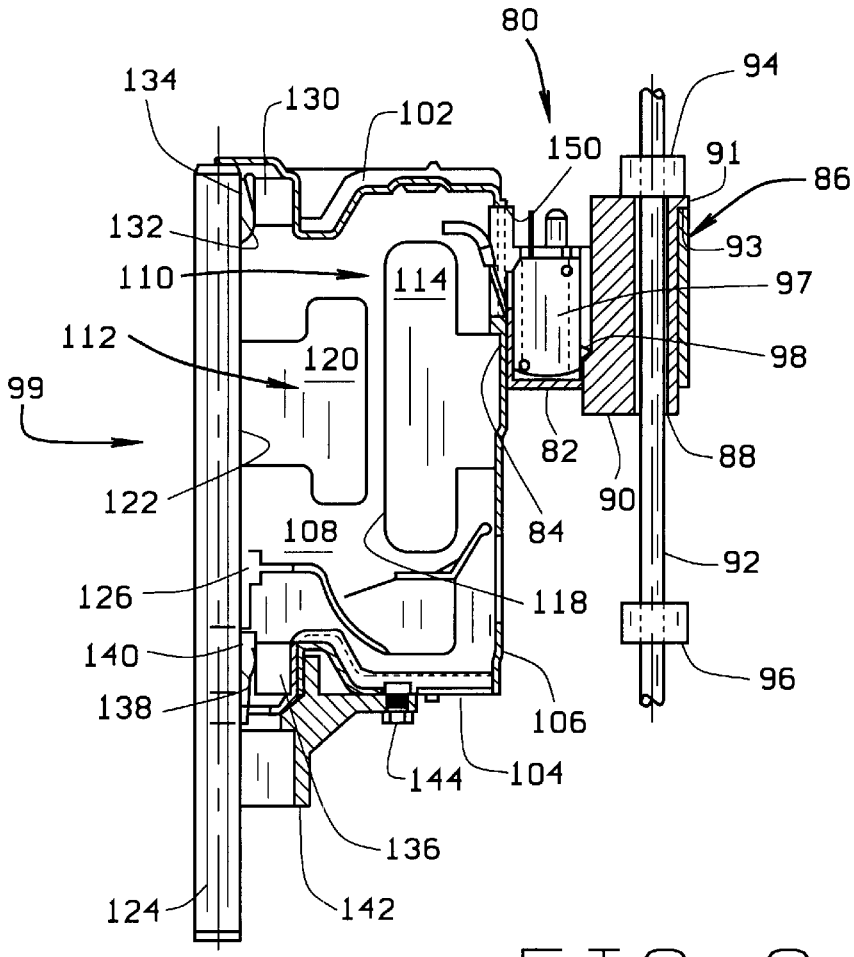
FIG. 2 is a cut-away side view of a sump pump motor switch assembly for the sump pump assembly shown in FIG. 1.

FIG. 2 is a side view of a de-energized sump pump motor switch assembly 80 for a sump pump assembly (not shown in FIG. 2) similar to sump pump assembly 10 shown in FIG. 1. Switch assembly 80 includes a housing 82 having a base surface 84. Housing 82 includes a cam actuator assembly 86 mounted within an opening 88 for actuating switch assembly 80. Cam actuator assembly 86 includes a cam actuator body 90 having a shoulder 91 and a float rod 92 having a first cam position stop 94 and a second cam position stop 96 adjustably mounted to it. Float rod 92 also includes a float (not shown in FIG. 2). Body 90 is slidably connected to housing 82 and reciprocates with respect to housing 82 in a direction substantially parallel to the movement of float rod 92. Body 90 also includes an upper surface 93. Shoulder 91 and upper surface 93 prevent body 90 from sliding through housing 82 when first cam position stop 94 contacts body 90. As discussed above, when drainage out of a sump causes the float to fall, downward movement of float rod 92 will cause first cam position stop 94 to move downward until contacting body 90. Body 90 moves to a position adjacent housing 82 and shoulder 91 contacts upper surface 93. When body 90 is positioned adjacent housing 82 and shoulder 91 contacts upper surface 93, switch assembly 80 is in the "OFF" position and the sump pump assembly is de-energized.

Switch assembly 80 is electrically connected to sump pump motor assembly 99 and includes a sump pump actuation switch 97 positioned within switch assembly housing 82 and mounted with cam actuator body 90, and a motor actuation switch (not shown) also positioned within housing 82 and integrally mounted with cam actuator body 90. The motor actuation switch and sump pump actuation switch 97 are both snap action switches which are connected to cam actuator assembly 86 and simultaneously actuated when second cam position stop 96 is elevated to a position adjacent body 90. Sump pump actuation switch 97 is electrically connected to a sump pump motor main winding (not shown) and the motor actuation switch is electrically connected in series to a sump pump motor start winding (not shown).

Housing 82 is mounted to sump pump motor assembly 99 which includes a first end shield 102 and a second end shield 104 both mounted to a motor casing 106. End shield 102, end shield 104, and motor casing 106 form a cavity 108. A stator assembly 110 and a rotor assembly 112 are positioned within cavity 108. Stator assembly 110 includes a stator core 114 including a plurality of stator windings (not shown), and a stator bore 118 extending through stator core 114. The stator windings are positioned circumferentially around stator bore 118. Rotor assembly 110 includes a rotor core 120, a rotor bore 122 extending therethrough, and a rotor shaft 124 positioned within rotor bore 122. A cooling fan 126 is positioned within cavity 108 and is mounted to rotor shaft 124.

Motor casing 106 includes a first interior wall 130 having a cavity 132 located therein. A sleeve bearing 134 is positioned in cavity 132 and contacts rotor, shaft 124. Motor casing 106 also includes a second interior wall 136 having a cavity 138 located therein. A sleeve bearing 140 is positioned in cavity 138 and contacts rotor shaft 124. In an exemplary embodiment, bearing 134 and bearing 140 are sleeve bearings available from Spyraflo, Peachtree City, Ga. 30269.

Figure 3:
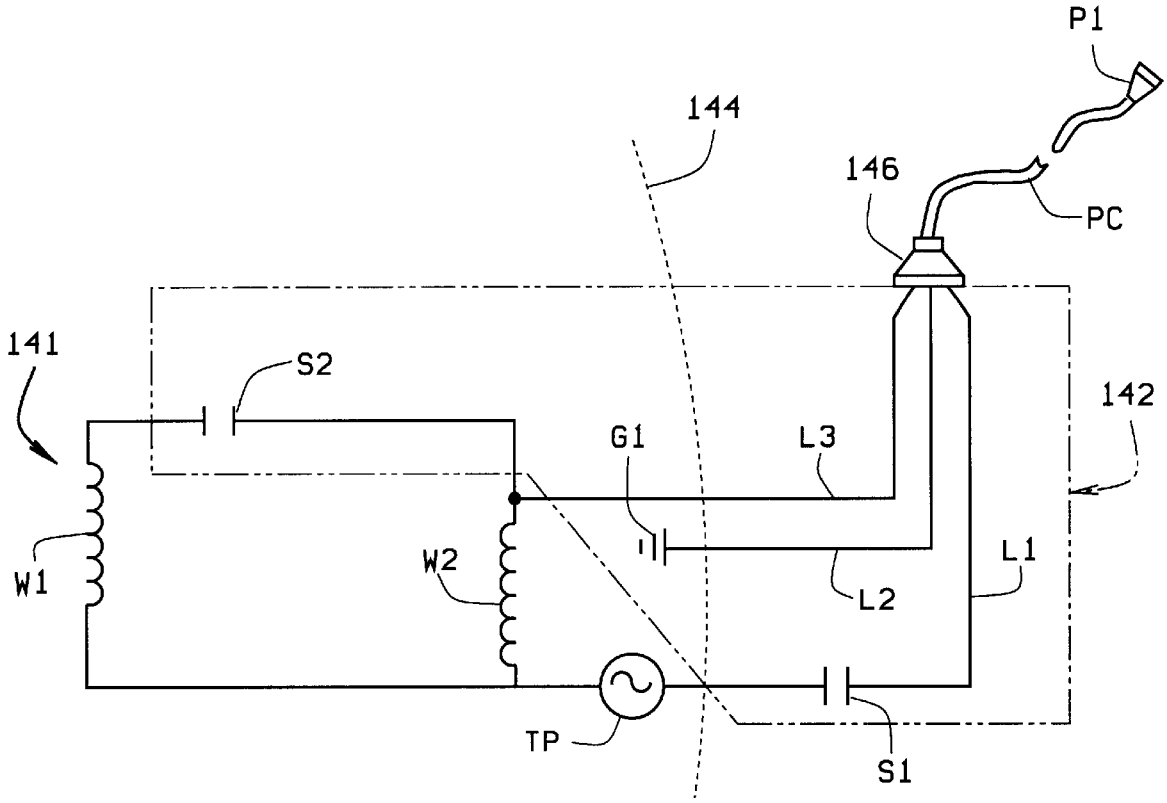
FIG. 3 is a circuit schematic for the sump pump motor switch assembly shown in FIG. 2.

FIG. 3 is a circuit schematic of a motor circuit 141 for a sump pump motor assembly (not shown), such as sump pump motor assembly 12 shown in FIG. 1. A sump pump motor switch assembly 142 is similar to sump pump motor switch assembly 80 (shown in FIG. 2), and includes a sump pump motor actuation switch S2 and a sump pump actuation switch S1. Sump pump motor actuation switch S2 is electrically connected in series between a motor start winding W1 and a motor main winding W2. Sump pump motor actuation switch S2 is similar to sump pump actuation switch 97 (shown in FIG. 2), and is normally open. Sump pump motor actuation switch S2 is actuated by either a cam actuator assembly similar to cam actuator assembly 86 (shown in FIG. 2), or by a conventional motor centrifugal mechanism (not shown).

Sump pump actuation switch S1 is normally open and is electrically connected in series with a thermal protector TP and in series with motor start winding W1 and motor main winding W2. Sump pump actuation switch S1 can simultaneously actuate motor start winding W1 and motor main winding W2. Motor start winding W1, motor main winding W2, and sump pump motor actuation switch S2 are positioned within motor housing 144.

Switch assembly 142 includes an interconnect 146. Three electrical lines L1, L2, and L3 connect motor circuit 141 to interconnect 146. Specifically, electrical line L1 connects with a line cord provision (not shown in FIG. 3), electrical line L2 connects with a grounding provision G1, and electrical line L3 connects with a neutral provision (not shown in FIG. 3). Interconnect 146 is connected to a power cable PC which terminates in a plug P1 and provides a source of electrical power.

Figure 4:
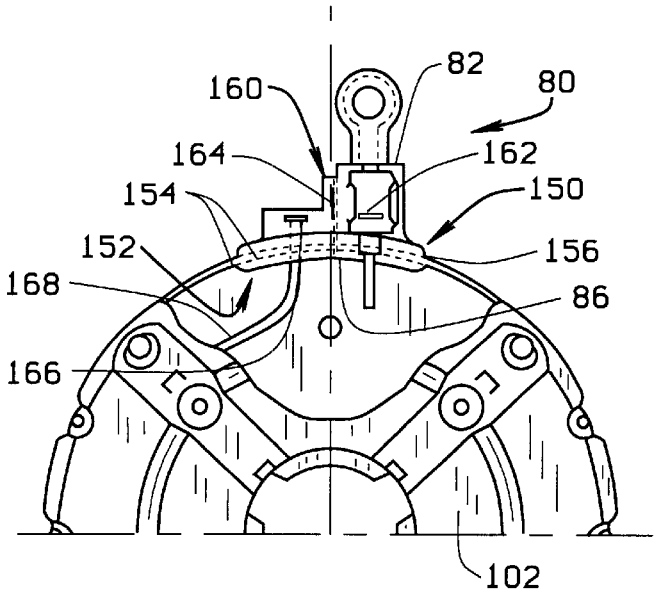
FIG. 4 is a partial plan view of the sump pump assembly shown in FIG. 2.

FIG. 4 is a partial plan view of the sump pump assembly described above in FIG. 2. Housing base surface 84 has a snap fitting retainer assembly 150 which attaches to an opening 152 positioned within motor casing 106 adjacent to first end shield 102. Snap fitting retainer assembly 150 includes a plurality of generally parallel resilient legs 154 which extend from base surface 84. A gap 156 extends between adjacent legs 154. During assembly, switch assembly 80 is attached to motor casing 106 with snap fitting retainer assembly 150. Snap fitting retainer assembly 150 is slidably positioned within opening 152 such that motor casing 106 is positioned between adjacent legs 154 within gap 156 such that adjacent legs 154 contact motor casing 106.

Switch assembly 80 includes an interconnect 160 positioned within housing 82. Interconnect 160 includes a line cord provision 162, a grounding provision 164, and a neutral provision 166. Interconnect 160 enables a separate power supply cord (not shown in FIG. 4) to be attached directly to switch assembly 80. Interconnect 160 also enables a separate power supply cord to be installed to replace an originally installed power supply cord (not shown) that is damaged. An electrical lead 168 is connected between neutral provision 166 and a sump pump motor neutral provision (not shown).

Figure 5:
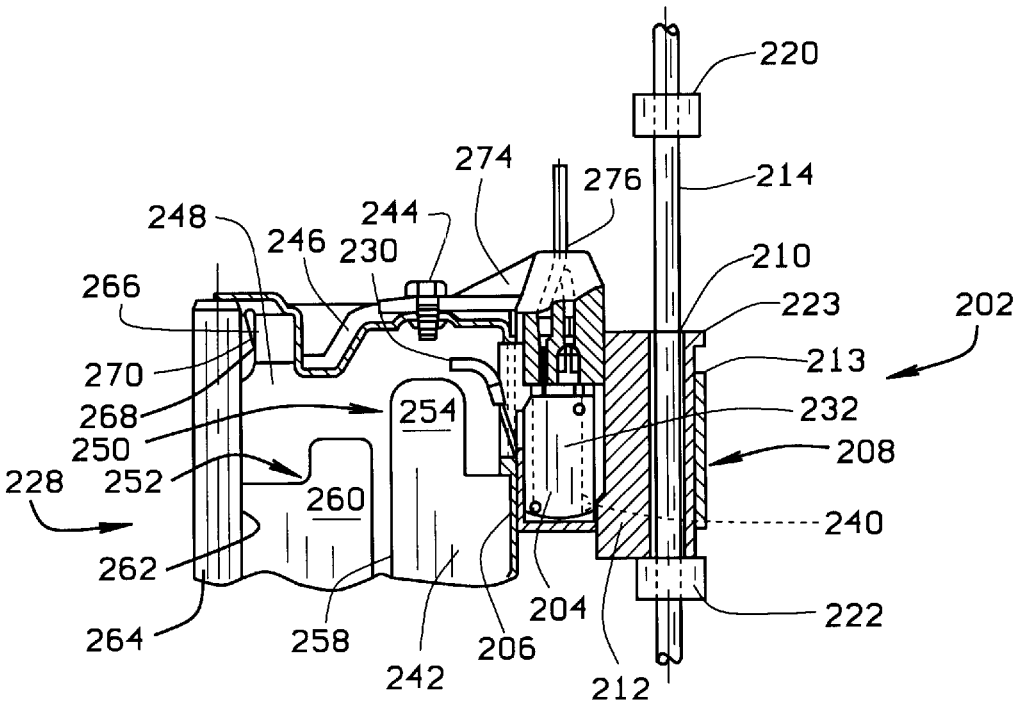
FIG. 5 is a cut-away side view of an alternative embodiment of a sump pump motor switch assembly for the sump pump assembly shown in FIG. 1.

FIG. 5 is a cut-away side view of an alternative embodiment of an energized sump pump motor switch assembly 202 for a sump pump assembly (not shown in FIG. 5) similar to that shown in FIG. 1. Switch assembly 202 includes a housing 204 having and a base surface 206. A cam actuator assembly 208 is mounted within an opening 210 in housing 204 and controls the energization of switch assembly 202. Cam actuator assembly 208 includes a cam actuator body 212 having a shoulder 213 and a float rod 214. Float rod 214 has a first cam position stop 220, a second cam position stop 222, and a float (not shown in FIG. 5) attached to it. Body 212 is slidably connected to housing 204 and reciprocates with respect to housing 204 in a direction substantially parallel to the movement of float rod 214. Body 212 also includes an upper surface 223. Shoulder 213 and upper surface 223 prevent body 212 from sliding through housing 204 when first cam position stop 220 contacts body 212. As discussed above, when drainage into a sump causes the float to rise, upward movement of float rod 214 will cause second cam position stop 222 to raise upward until contacting body 212. When second cam position stop 222 is positioned adjacent to body 212, switch assembly 202 is in the "ON" position and the sump pump assembly is energized.

Switch assembly 202 is electrically connected to sump pump motor switch assembly 228 and includes a sump pump actuation switch 232 and a motor actuation switch (not shown), both positioned within switch assembly housing 204 and both integrally mounted with cam actuator body 212. Both the motor actuation switch and sump pump actuation switch 232 are snap action switches which are connected to cam actuator assembly 208 and simultaneously activated when second cam position stop 222 is elevated to a position adjacent to cam body 212. Sump pump actuation switch 232 is electrically connected to a sump pump motor main winding (not shown) and the motor actuation switch is electrically connected to a sump pump motor start winding (not shown).

Sump pump actuation switch 232 includes a contact button 240 that extends from the snap action switch and is biased by cam actuator body 212. Contact button 240 is normally biased to be in a fully extended condition (not shown in FIG. 5). When float rod 214 is elevated, second cam position stop 222 contacts body 212 and causes body 212-to reciprocate upward, biasing contact button 240 from the extended "OFF" position to the retracted "ON" position (shown in FIG. 5). The motor actuation switch includes a contact button (not shown) which operates in a similar manner.

Housing 204 is mounted to sump pump motor assembly 228 which includes a motor casing 242 and a threaded connecter 244. A first end shield 246 and a second end shield (not shown) are mounted to motor casing 242. A cavity 248 is formed by first end shield 246, the second end shield, and motor casing 242. A stator assembly 250 and a rotor assembly 252 are positioned within cavity 248. Stator assembly 250 includes a stator core 254, a plurality of stator windings (not shown), and a stator bore 258 extending through stator core 254. Rotor assembly 252 includes a rotor core 260, a rotor bore 262 extending therethrough, and a rotor shaft 264 positioned within rotor bore 262.

Motor casing 242 includes a first interior wall 266 and a second interior wall (not shown). First interior wall 266 has a cavity 268 located within it. A sleeve bearing 270 is positioned within cavity 268 and contacts rotor shaft 264. In an exemplary embodiment, bearing 270 is a sleeve bearing available from Spyraflo, Peachtree City, Ga. 30269.

Figure 6:
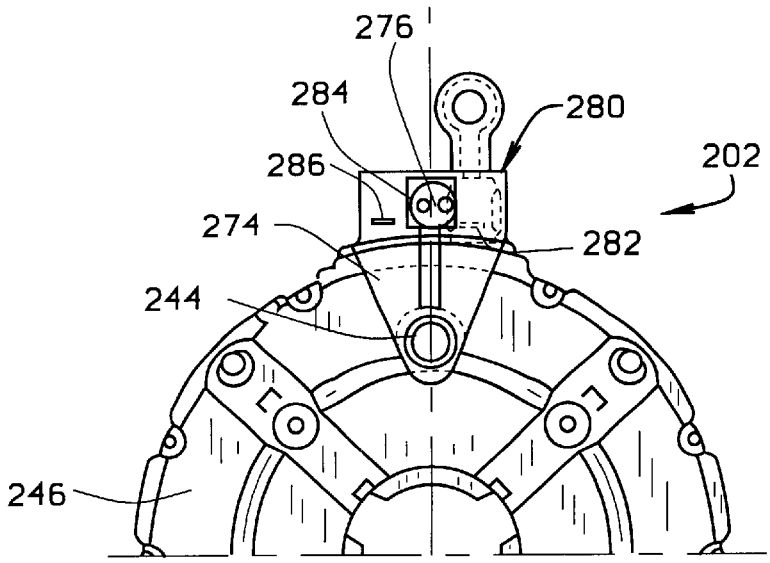
FIG. 6 is a partial plan view of the sump pump assembly shown in FIG. 5.

FIG. 6 is a partial plan view of the sump pump assembly described above in FIG. 5. Switch assembly 202 is mounted to first end shield 246 using threaded connector 244 and a bracket 274. Bracket 274 is an integral bracket molded directly to a separate power supply cord 276. Bracket 274 anchors power supply cord 276 to motor casing 242 and provides strain relief to power supply cord 276.

Switch assembly 202 also includes an interconnect 280 positioned within switch assembly housing 204. Interconnect 280 includes a line cord provision 282, a grounding provision 284, and a neutral provision 286. Interconnect 280 enables power supply cord 276 to be attached directly to switch assembly 202 to replace an originally installed power supply cord (not shown) that has been damaged.

The present invention provides a motor circuit for a sump pump which integrally combines a motor actuation switch, a sump pump actuation switch, and a cam actuator into one switch assembly. The cam actuator has cam position stops which permit the sump pump motor assembly to rapidly be actuated or de-actuated depending on the position of the cam actuator. Furthermore, the switch assembly is quickly attached to the motor casing with a snap fitting assembly. As a result, the sump pump motor assembly is inexpensive, simple, and quick to assemble when compared to other sump pump assemblies currently in use. Additionally, the switch assembly for the sump pump motor assembly includes an interconnect which enables a separate power supply cord to be easily installed or to replace an existing damaged power supply cord. As such, a cost effective and reliable sump pump assembly is provided.

While the invention has been described in terms of various specific embodiments, those skilled in the art will recognize that the invention can be practiced with modification within the spirit and scope of the claims.

What is claimed is:

1. A switch assembly for a sump pump including a motor casing and an end shield, said switch assembly comprising:

a housing mounted to the end shield;

a cam actuator connected to said housing, said cam actuator comprising a body and a float rod, said float rod slidably engaging said body, said cam body configured to actuate a motor actuation switch; and a sump pump actuation switch mounted within said cam actuator body, said cam actuator connected to said sump actuation switch and to the motor actuation switch.

2. A switch assembly in accordance with claim 1 wherein said housing comprises a base and an outer surface, said outer surface receiving said cam actuator, said housing further comprising a snap fitting retainer configured to engage the motor casing.

3. A switch assembly in accordance with claim 2 wherein said snap fitting retainer comprises a plurality of generally parallel resilient legs extending from said housing base and a gap extending between adjacent legs.

4. A switch assembly in accordance with claim 1 wherein said cam actuator comprises a float switch moveable from a first position to a second position.

5. A switch assembly in accordance with claim 4 wherein said motor actuation switch is a snap action switch, said motor actuation switch configured to be energized when said cam actuator reciprocates to said second position.

6. A switch assembly in accordance with claim 4 wherein said sump actuation switch is a snap action switch, said sump actuation switch energized when said cam actuator reciprocates to said second position.

7. A switch assembly in accordance with claim 1 further comprising an interconnect comprising a line cord and a grounding provision.

8. A switch assembly in accordance with claim 1 wherein said housing comprises a base and an outer surface configured to attach to the motor casing, said outer surface receiving said cam actuator.

9. A switch assembly in accordance with claim 1 further comprising a mounting hub attached to the motor casing.

10. A switch assembly in accordance with claim 1 wherein said motor actuation switch is mounted with said cam actuator body internal said housing, said sump pump actuation switch is mounted with said cam actuator body internal said housing.

11. A switch assembly in accordance with claim 1 wherein said motor actuation switch is mounted with said cam actuator body such that said motor actuation switch actuates substantially simultaneously with an actuation of said sump pump actuation switch.

12. A switch assembly in accordance with claim 10 wherein said motor actuation switch is mounted with said cam actuator body internal said housing such that said motor actuation switch actuates substantially simultaneously with an actuation of said sump pump actuation switch mounted internal said housing.

13. A method of assembling a switch assembly for a sump pump for use in controlling a drainage level in a sump, the sump pump including a motor, a motor shell, and an end shield mounted to the motor shell, the switch assembly including a housing, said method comprising the steps of:

connecting a cam actuator to the housing, the cam actuator including a body and a float rod, wherein the cam body is configured to actuate a motor actuation switch substantially simultaneously with an actuation of the sump pump actuation switch by the cam body;

mounting a sump pump actuation switch adjacent to the cam actuator body, such that the sump pump actuation switch and the motor actuation switch are actuated by the cam body; and mounting a motor actuation switch adjacent to the cam actuator body such that the motor actuation switch is actuated.

14. A method in accordance with claim 13 wherein the motor includes a casing including an interior wall including a cavity, said method further comprising the step of installing a bearing within the cavity.

15. A method in accordance with claim 14 wherein the casing further includes a snap fitting retainer, said method further comprising the step of attaching the housing to the end shield.

16. A method in accordance with claim 13 wherein the cam actuator comprises a float switch moveable from a first position to a second position, said method further comprising the step of adjusting the cam actuator to energize the motor when the drainage level causes the float switch to reach the second position.

17. A method in accordance with claim 16 wherein the motor actuation switch is a snap action switch, said method further comprising the step of adjusting the motor actuation switch to energize the motor when the cam actuator reciprocates to the second position.

18. A method in accordance with claim 16 wherein the sump pump actuation switch is a snap action switch, said method further comprising the step of adjusting the sump pump actuation switch to energize the motor when the cam actuator reciprocates to the second position.

19. A method in accordance with claim 13 wherein said method further comprising the step of mounting an interconnect to the housing.

20. A method in accordance with claim 13 wherein said step of connecting a cam actuator further comprises the step of connecting said cam actuator to the housing, the cam actuator comprising a body and a float rod slidably engaged with said body.

21. A method in accordance with claim 13 wherein said step of mounting a sump pump actuator switch further comprises the step of mounting said sump pump actuation switch adjacent to the cam actuator body internal the housing, and wherein said step of mounting a motor actuation switch further comprises the step of mounting a motor actuation switch adjacent to the cam actuator body internal the housing.

22. A method in accordance with claim 20 further comprising the steps of:

mounting a sump pump actuation switch to the cam actuator internal the housing; and mounting a motor actuation switch to the cam actuator body internal the housing.

23. A sump pump comprising:

a motor comprising an end shield and a motor casing, said end shield mounted to said motor casing;

a switch assembly for controlling energization of said motor, said switch assembly comprising a cam actuator comprising a body and a float rod, and a sump pump actuation switch mounted within said cam actuator body, said cam actuator connected to said sump pump actuation and a motor actuation switch, said float rod mounted adjacent to said sump actuation switch and said motor actuation switch.

24. A sump pump in accordance with claim 23 wherein said switch assembly further comprises a housing comprising a snap fitting retainer configured to engage said motor casing.

25. A sump pump in accordance with claim 24 wherein said motor casing comprises an interior wall including a cavity for receiving a bearing.

26. A sump pump in accordance with claim 24 wherein said switch assembly further comprises an interconnect comprising a line cord and a grounding provision.

27. A sump pump according to claim 23 wherein said float rod slidably engages said cam actuator body.

28. A sump pump according to claim 23 wherein said motor actuation switch is mounted within said cam actuator body such that said motor actuation switch actuates substantially simultaneously with an actuation of said sump pump actuation switch.

29. A sump pump according to claim 27 wherein said motor actuation switch is mounted within said cam actuator body such that said motor actuation switch actuates substantially simultaneously with an actuation of said sump pump actuation switch.

* * * * *